United States Patent [19]

Quigley

[11] 4,404,437

[45] Sep. 13, 1983

[54] MOLDED SNAP-IN SWITCH HAVING MOVABLE CONTACT BLADE WHICH USES COMPOUND MOTION

[75] Inventor: Thomas J. Quigley, Newtown, Pa.

[73] Assignee: Continental-Wirt Electronics Corporation, Southampton, Pa.

[21] Appl. No.: 301,150

[22] Filed: Sep. 11, 1981

[51] Int. Cl.[3] ..... H01H 15/02

[52] U.S. Cl. ..... 200/16 C

[58] Field of Search ..... 200/16 C, 16 D, 67 G, 200/76

[56] References Cited

U.S. PATENT DOCUMENTS

| | | | |
|---|---|---|---|
| 3,339,032 | 8/1967 | Hults | 200/16 C |
| 3,469,042 | 9/1969 | Sandor | 200/16 C |
| 3,536,872 | 10/1970 | Glardenghi | 200/67 G |
| 3,586,796 | 6/1971 | Simovits, Jr. et al. | 200/67 G X |
| 4,072,834 | 2/1978 | Godfrey | 200/16 C |
| 4,128,745 | 12/1978 | Marsilio et al. | 200/16 C |

*Primary Examiner*—J. R. Scott

*Attorney, Agent, or Firm*—Ostrolenk, Faber, Gerb & Soffen

[57] ABSTRACT

A slide switch is disclosed which is contained within a molded housing. The contact blade of the slide switch is pivoted at its center and is biased into sliding engagement with first and second spaced contacts by a spring pressing in the region of the pivotal axis of the sliding blade. Electrical terminals are connected to or are integral with the first and second contacts. A third contact or insulation pedestal is aligned in a row with the first and second contacts, with the center contact being slightly higher than the end contacts. When the pivot of the blade moves to either side of the central contact, the contact blade tilts on the central contact with a snap action during contact make and contact break with respect to the one or both of the end contacts, with arcs drawn to the very end of the tilting contact blade. During the contact engagement action, the sliding blade slides over the end contact with wiping action which ensures clean contact surfaces for the contact blade and end contact when the sliding contact blade comes to rest. The third contact or pedestal serves as a tilt stop for the sliding contact blade when it is moved to the open position and can be connected to a third conductive terminal.

9 Claims, 9 Drawing Figures

MOLDED SNAP-IN SWITCH HAVING MOVABLE CONTACT BLADE WHICH USES COMPOUND MOTION

BACKGROUND OF THE INVENTION

Molded switches having relatively low power ratings, for example, up to 15 amperes at 120 volts a-c are well known. These switches employ toggle arm operators, push-button operators and sliding operators. In many appliances, it has been found advantageous to employ a sliding switch since the user operates the switch while holding the appliance conveniently near the switch housing rather than having to grip the opposite side of the appliance to hold it steady while operating a push-button or toggle-type switch. Relatively low power slide switches for appliances must be inexpensive, reliable and have a long useful life.

In slide switches of prior art construction, a sliding blade slides over and makes continuous sliding contact with a central terminal. The other end of the blade then slides into and out of engagement with a second contact terminal for the switch. Consequently, the same surface portion of the sliding blade which contacts the second contact terminal when the switch is fully closed is also exposed to contact make and break arcing. Thus the sliding contact surface becomes pitted so that the contact resistance and resultant heating of the closed switch increases and the life of the switch is reduced.

BRIEF DESCRIPTION OF THE INVENTION

The present invention provides a novel action for a sliding switch, wherein the sliding contact blade tips with a slight snap action at the instant the contact blade end is in alignment with the end terminal of the switch. Therefore, all arcing and resultant pitting caused by opening and closing the contact blade occurs at the end of the blade.

During the closing operation, the blade continues to move so that its end overlaps the end terminal, to cause a contact wiping action between the end terminal and contact blade. When the contact blade comes to rest in its fully closed position, the end contact engages the blade on a surface which is constantly wiped clean during the operation of the switch.

The novel snap action pivoting is obtained by pivotally mounting the contact blade about an axis in a contact blade carrier and providing a biasing spring disposed above this central pivotal axis. Consequently, as the contact blade moves to either side of a central terminal support, the blade will snap in a pivotal motion between two angular stop positions.

A stop member consisting of a third contact or pedestal can be provided beneath the other switch blade end to prevent excessive opening rotation of the switch blade during the opening operation.

The novel switch structure, therefore, has the characteristic that, in the contact closed position, contact is always made between clean surfaces, thus maintaining the lowest possible resistance circuit path and improving the ability of the switch to carry rated current without excessive heating. Moreover, the life of the switch is increased and these advantages are obtained without any increase in cost for the switch.

DETAILED DESCRIPTION OF THE DRAWINGS

Figure 7:
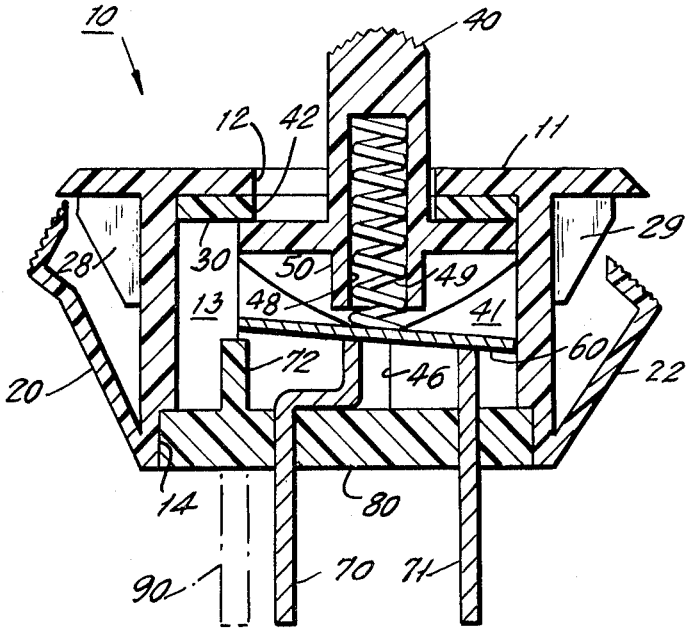
FIG. 7 is a cross-sectional view of FIG. 2 taken across the section line 7—7 in FIG. 2, with the contact blade shown in its fully closed position.

Referring first to FIGS. 1, 2, 3 and 7, there is shown the main molded insulation housing 10 for the switch. The housing 10 has a face plate 11 which has tapered edges, as best shown in FIG. 7, and a rectangular switch operator opening 12. The housing 10 contains a rectangular well 13 (FIG. 7) formed by four integrally molded sides and has an open bottom best shown in FIG. 7, which has a shoulder 14 therein.

Figure 1:
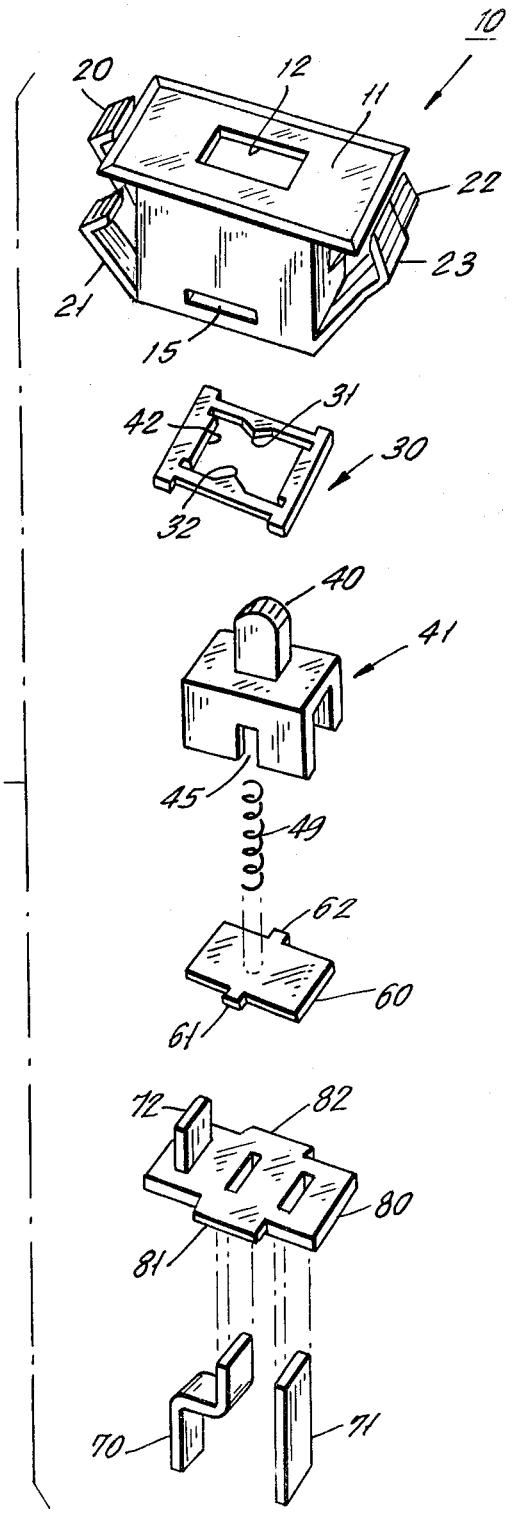
FIG. 1 is an exploded perspective view of the novel switch of the invention.
Figure 2:
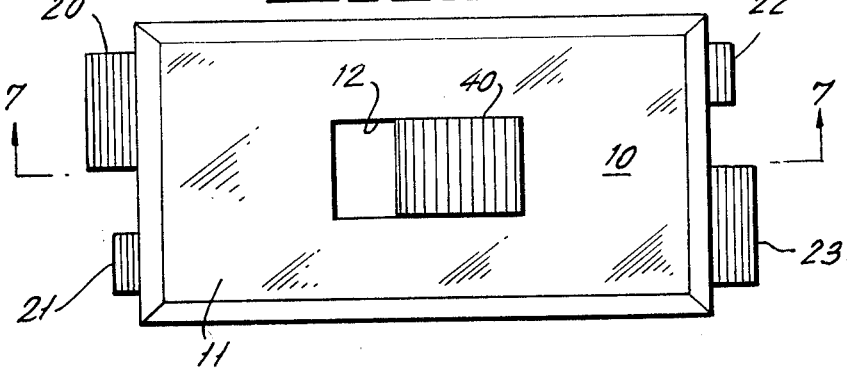
FIG. 2 is a plan view of the top of the assembled switch of FIG. 1.

The two opposing sides of well 13 contain snap-receiving openings, only one of which is shown as opening 15 in FIG. 1. An identical opening to opening 15 opposes the opening in the opposite surface of the housing forming well 13.

The outer edges of the housing 10 contain flexible snap-in mounting members 20, 21, 22 and 23 which are serrated at their tops. Members 20, 21, 22 and 23 serve as latches which hold the face plate 11 of housing 10 against a mounting surface when the body of the housing 10 is inserted through an opening in the mounting surface. The members 20 through 23 are pressed inwardly when moved through the opening in the appliance which is to receive the switch and then snap out into engagement with the interior surface of the mounting member.

Figure 3:
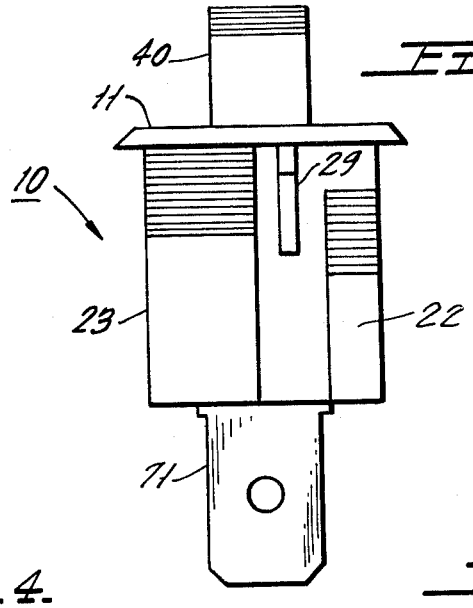
FIG. 3 is an elevational view of the switch of FIG. 2 when seen from the end of the switch.
Figure 4:
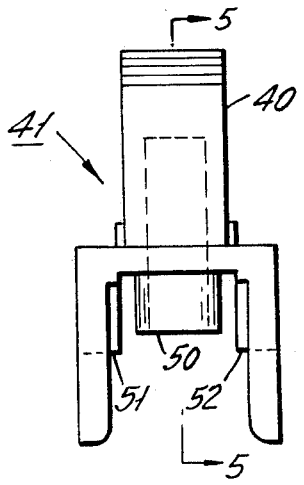
FIG. 4 shows an elevational view of the sliding contact blade carrier which is shown in detail in FIG. 1.

The portion of the face plate 11 which overhangs the body of the plastic housing forming the well 13 may be additionally reinforced by reinforcing ribs, such as ribs 28 and 29 shown in FIGS. 3 and 7.

Immediately beneath the upper surface of well 13 is a detent plate 30 (FIGS. 1 and 7) of well-known design which is a molded plastic member having inwardly projecting surfaces 31 and 32 (FIG. 1) which serve to hold an operating handle 40 in either a fully-on or fully-off position, and provides snap action for the movable contact handle in its operation.

The contact handle 40 is integral with a contact carrier 41, which will later be described, and projects through the rectangular opening 42 in member 30, which is aligned with opening 12 in the molded housing 10. The movable contact carrier 41, which is integrally molded with handle 40 has a flat upper surface which slides on the lower surface of plate 30. The two legs of member 41 both contain contact blade pivot-receiving slots shown in FIGS. 1, 5, 6 and 7 as slots 45 and 46.

Figure 5:
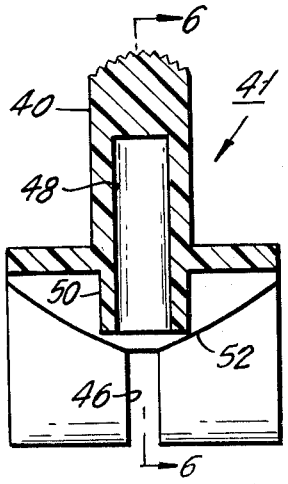
FIG. 5 is a cross-sectional view of the contact carrier of FIG. 4 taken across the section line 5—5 in FIG. 4.
Figure 6:
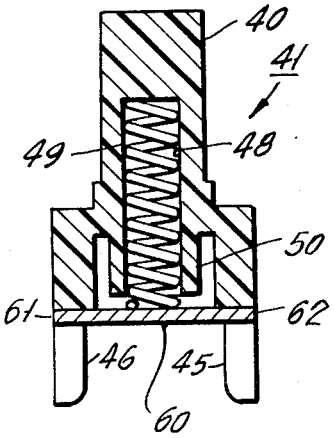
FIG. 6 is a cross-sectional view of the contact carrier of FIG. 5 taken across the section line 6—6 in FIG. 5 and further illustrates the contact blade which is pivoted within the contact carrier and the biasing spring above the blade.

The integrally molded blade carrier 41 also has an opening 48, shown in FIGS. 5, 6 and 7, which extends into the handle for reception of a compression spring 49, which is shown in FIGS. 1, 6, 7, 8 and 9. The compression spring 49 extends beyond the bottom of the integral tubular extension 50 of member 41.

The opposite sides of member 41 also contain internal arcuate shoulders 51 and 52 (FIGS. 5, 6 and 7) which guide the tilting of a contact blade 60, which serves as the movable, sliding and snap contact of the invention. Contact blade 60 is a rectangular blade of appropriate copper or copper alloy and has two central projecting ears 61 and 62 which are integral with the blade, as best shown in FIGS. 1 and 6. The projecting ears 61 and 62 of the contact blade are received by the slots 45 and 46, respectively, in the contact carrier 41 as shown in FIGS. 6 and 7, and the contact blade can pivot about the axis defined by ears 61 and 62 within the bottoms of the slots 45 and 46.

The spring 49 carried in the opening 48 of the contact carrier presses down directly on this pivotal axis of blade 60 formed by ears 61 and 62, as shown in FIGS. 6 and 7. The contact blade 60, however, is pressed against spring 49 and toward the bottom of slots 45 and 46 by the central switch terminal member 70 in cooperation with the outer switch terminal 71 and insulation pedestal 72. Members 70, 71 and 72 are arranged along a straight line.

Terminal members 70 and 71 are rectangular, conductive blades which serve as the outer terminals of the switch and they are rigidly secured within molded base 80 as by staking or any other desired method. Note that the central terminal blade 70 is offset to provide the desired spacing between the housing switch terminals below the base 80. The insulation base 80 is a molded member and the pedestal 72 may be integrally molded therewith.

The base 80 is pressed into the shoulder 14 at the bottom of well 13 of the insulation housing 10. Base 80 has projecting side ears 81 and 82 (FIG. 1) which snap into slot 15 and the slot identical to slot 15 in the wall of well 13, respectively, thereby to fix the base in position relative to insulation housing 10.

The end of the central conductive terminal 70, which may be of copper or other suitable conductive material, is rigid and serves as a terminal and a fixed contact and pivotal support member for the switch, and is slightly higher than terminal 71 and pedestal 72. For example, terminal 70 may have a height which is approximately 0.005 inch above the line which joins the tops of end terminal 71 and insulation pedestal 72. Consequently, the blade 60 will pivot from the position shown in FIG. 7, when the blade is in its fully closed contact position, to the slightly counterclockwise position of FIG. 9, when the blade is fully open.

Figure 9:
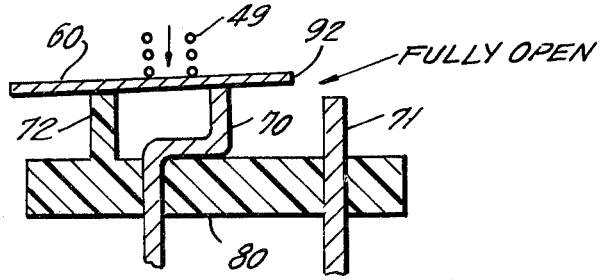
FIG. 9 is similar to FIG. 8 and shows the contact blade in its fully open position.

The contact carrier 41 and blade 60 are so dimensioned relative to the spacing of terminals 70, 71 and pedestal 72 that, when the contact carrier is fully to the right as shown in FIG. 7, the contact is fully closed, whereas, when the contact carrier is moved fully to the left, the contact blade 60 will be fully engaged relative to end terminal 71, as schematically shown in FIG. 9.

The device is shown for a two-terminal device and as a single pole, single throw switch. If desired, the insulation pedestal 72 can be a third conductive terminal similar in structure to terminal 71 and could have the terminal extension 90, illustrated in phantom lines in FIG. 7. The structure using a terminal in place of insulation pedestal 72 would convert the switch to a single pole, double throw switch.

Figure 8:
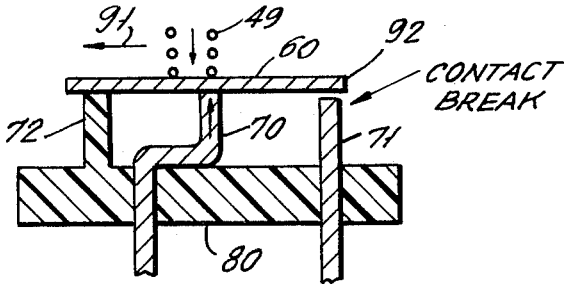
FIG. 8 illustrates the contact and terminal parts of FIG. 7 when the contact blade has just moved to its contact open position.

The operation of the novel switch structure described above is as follows:

The switch operates with snap action, such that the moving contact makes and breaks the circuit with a combination of sliding and tipping actions. All contact making and breaking will occur at or near the position of FIG. 8, when the center of spring 49 just passes to the left or to the right of the central terminal 70, thus causing contact break, as shown in FIG. 8, or contact make, when the contact blade 60 moves in a direction opposite to that of arrow 91.

During the time the contacts are making or breaking, the end of contact blade 60 will be aligned with end terminal 71 so that all arcing during making or breaking will be to the end 92 (FIG. 8) of the contact blade 60. The lower surface of contact blade 60 to the left of end 92 will slide over and finally rest atop the upper end of terminal 71 when the contact is fully closed as shown in FIG. 7. This surface will not be subjected to arc erosion. Moreover, the contact closing action is such that the lower surface of blade 60 wipes across the upper end of end terminal 71 under the pressure of biasing spring 49 to cause continuous wiping and cleaning of the contact surfaces which will engage when the blade 60 comes to rest on top of end terminal 71. Moreover, contact make operation occurs with a rapid snap action as soon as the center of spring 49 goes over and to the right of the blade 70, so that there is minimum prearcing during contact closing.

During the opening or break cycle, the contact blade 60 will move from the position shown in FIG. 7 and will wipe across the upper end of contact 71 until the center line of spring 49 passes to the left of terminal 70. At this time, the edge 92 of blade 60 is aligned with the upper end of terminal 71 and there will be snap opening of the end of the blade 60 and end terminal 71 to cause high speed opening with relatively little contact arcing. Moreover, the arc root of any arc which occurs is on the end 92 of the moving contact and does not affect the interior surface of the blade 60 which will rest on the top of terminal 71 in the fully closed position.

As a result of the novel structure, the life of the switch is increased and the switch will maintain its low contact resistance characteristics. Furthermore, the switch as shown employs a minimum number of parts and is easily assembled.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A snap-acting slide switch comprising:

an elongated sliding contact blade slidably movable along its length;

a contact blade carrier; means pivotally connecting said blade to said carrier for rotation about an axis of rotation which is fixed to said carrier and which is in the plane of said blade and perpendicular to the direction of movement of said blade;

a fixed central conductive terminal member having a first support portion which slidably receives one surface of said sliding contact blade;

a fixed end conductive terminal having a second support portion which is spaced from said first support portion of said central terminal member and is disposed along the direction of movement of said sliding contact blade;

a stop member having a third support portion which is spaced from said first support portion on the side thereof opposite to said second support portion and disposed along the direction of movement of said contact blade;

said elongated contact blade having a length at least equal to the distance between said second and third support portions;

a biasing means connected to said sliding contact blade at its said axis of rotation and pressing said blade against said first support portion;

said first support portion being disposed above the extension of a straight line extending between said second and third portions whereby, when said axis of rotation of said blade slides to one side of said first support portion, said blade rotates with snap action about said axis to engage said second support portion and, when said blade slides to the opposite side of said first support portion, said blade rotates with snap action about said axis to engage said third support portion.

2. The switch of claim 1, wherein said fixed central conductive terminal member and said fixed end conductive terminal are both flat, conductive blades having at least portions thereof disposed generally perpendicularly to the plane of said contact blade; said first and second support portions constituting the ends of said fixed central terminal member and said end terminal.

3. The switch of claim 1, wherein said biasing means consists of a compression spring supported within said contact blade carrier.

4. The switch of claim 1, 2 or 3, wherein said contact blade carrier consists of an integrally molded U-shaped member having first and second legs having respective slots therein; said blade having centrally disposed extending ears aligned with said axis of rotation; said extending ears being disposed within respective ones of said slots in said contact blade carrier; said compression spring biasing said blade toward said first support portion.

5. The switch of claim 1, 2 or 3, which further includes molded housing means for supporting said fixed end conductive terminal, said fixed central conductive terminal member and said stop member in respective fixed positions and for slidably receiving said contact blade carrier.

6. The switch of claim 4, which further includes molded housing means for supporting said fixed end conductive terminal, said fixed central conductive terminal member and said stop member in respective fixed positions and for slidably receiving said contact blade carrier.

7. The switch of claim 4, wherein said contact blade carrier has a handle extending therefrom; said handle extending through a cooperating slot in said molded housing means and being operable in a sliding mode of operation externally of said housing means.

8. The switch of claim 1, 2 or 3, wherein said stop member is an insulation projection extending parallel with said fixed central conductive terminal member and said fixed end conductive terminal.

9. The switch of claim 1, 2 or 3, wherein said stop member comprises a third conductive terminal.

* * * * *